US005443433A

United States Patent [19]

Krag

[11] Patent Number: 5,443,433

[45] Date of Patent: Aug. 22, 1995

[54] SKI POLE ENHANCEMENT FOR CROSS-COUNTRY SKI SIMULATOR

[76] Inventor: Niels Krag, 639 Enchanted Way, Pacific Palisades, Calif. 90272-2817

[21] Appl. No.: 295,290

[22] Filed: Aug. 24, 1994

[51] Int. Cl.[6] ..... A63B 23/00

[52] U.S. Cl. ..... 482/70; 482/51

[58] Field of Search ..... 482/70, 51, 52, 54, 482/134, 148, 71

[56] References Cited

U.S. PATENT DOCUMENTS

| | | | |
|---|---|---|---|
| 3,205,025 | 7/1965 | Jordan . | |
| 3,488,097 | 1/1970 | Fall . | |
| 3,941,371 | 3/1976 | Lie . | |
| 4,023,795 | 5/1977 | Pauls . | |
| 4,089,568 | 5/1977 | Fall . | |
| 4,252,382 | 2/1981 | Thomas . | |
| 4,402,506 | 9/1983 | Jones . | |
| 4,434,981 | 3/1984 | Norton . | |
| 4,512,571 | 4/1985 | Hermelin . | |
| 4,529,194 | 7/1985 | Haaheim . | |
| 4,618,139 | 10/1986 | Haaheim . | |
| 4,632,385 | 12/1986 | Geraci . | |
| 4,867,443 | 9/1989 | Jensen . | |
| 4,969,276 | 10/1990 | Feuer . | |
| 5,064,190 | 11/1991 | Holt . | |
| 5,192,257 | 3/1993 | Panasewicz | 482/70 |

FOREIGN PATENT DOCUMENTS

| | | | |
|---|---|---|---|
| 1225674 | 8/1987 | Canada . | |
| 0207538 | 2/1940 | Switzerland | 482/70 |

*Primary Examiner*—Stephen R. Crow

*Attorney, Agent, or Firm*—Freilich Hornbaker Rosen

[57] ABSTRACT

An attachment is provided for use with a NORDICTRACK CROSS-COUNTRY SKI EXERCISER, which greatly reduces the time for comfortable use of the exerciser and which provides ski-pole operation exercise. The attachment (14, FIG. 1) comprises a framework (30) that includes stationary guides (32, 34) mountable on opposite sides of the existing machine (12) and a pair of slides (40, 42) that are each slidable in forward and rearward directions on a corresponding guide, with the bottoms of ski poles (44, 46) being mounted on each slide. A cable (62) that extends around pulleys mounted on the framework, connects the two slides to cause them to move in synchronism. The guides are sidewardly spaced from opposite sides of the machine frame (36) to provide enhanced lateral stability, for the person exercising. The arm rope pulling mechanism of the NORDICTRACK exerciser provides resistance to ski pole movement. The attachment 14 attaches to the NORDICTRACK frame with four bolts and wing nuts at existing NORDICTRACK bolt hole locations.

6 Claims, 5 Drawing Sheets

SKI POLE ENHANCEMENT FOR CROSS-COUNTRY SKI SIMULATOR

BACKGROUND OF THE INVENTION

Cross-country ski stimulator machines have become popular, with the NORDICTRACK models sold by NORDICTRACK, Inc., being very popular. Such machines include a pair of skis slidably mounted on a frame to move forward and rearward in opposite synchronism, with resistance, to provide exercise simulating cross-country skiing. Such machines also encourage exercise by providing a rope that extends around a pulley which resists turning, with the person encouraged to pull opposite ends of the rope as he skis.

Experience shows that it takes about a week or more of use of the machine, for at least about 30 minutes per day, for a person to become comfortable in using the above-mentioned machine. As a result, it is common for a purchaser to try the machine a few times, and then store it away. The skis are spaced apart (center-to-center) by about eight inches and are each perhaps two inches wide to simulate cross-country skiing. The close lateral spacing of the skis provides insufficient lateral stability for a person to feel comfortable, until about a week of use. While the skis exercise the legs in a manner comparable to cross-country skiing, the exercise obtained by pulling on a rope, does not exercise the same muscles as are used in operating ski poles during actual cross-country skiing, and the pulling of ropes does not help train a person in the proper use of ski poles. An attachment for an existing cross-country ski simulating machine or a new cross-country ski simulating machine, or a new cross-country ski simulating machine, which enabled persons to become comfortable in the use of the machine over a short period of use and which provided exercise and training of arm muscles for actual cross-country skiing, would be of value.

SUMMARY OF THE INVENTION

In accordance with one embodiment of the present invention, a cross-country ski simulator and an attachment for a prior art simulator are provided, which enables new users to quickly become comfortable in their use and which more completely simulates proper cross-country skiing. An attachment for a prior art machine such as a NORDICTRACK machine includes a framework comprising a pair of stationary guides that are mountable on the left and right sides of a prior art machine. A pair of slides are each slidable in forward and rearward directions on a corresponding one of the guides, and a pair of ski poles each has a lower end pivotally mounted on a corresponding one of the slides. A cable mechanism connects the slides to each other to assure that they move in opposite synchronism, so one moves forward as the other moves rearward.

The framework which includes the stationary guides, preferably includes spacers that position the beams so the slides and the bottoms of the ski poles are widely spaced apart. The lateral spacing between the bottoms of the ski poles is at least twice the lateral spacing of the skis. The wide spacing of the ski poles provides lateral stability during early stages of use, to more quickly make the user become comfortable with the use of the machine.

The slides are preferably coupled to the guides by a ball cage assembly such as the type used to mount drawers in a file cabinet, so the slide can extend far forward and rearward for full pole stride or reach, and yet permit compact storage and transport.

The novel features of the invention are set forth with particularity in the appended claims. The invention will be best understood from the following description when read in conjunction with the accompanying drawings.

DESCRIPTION OF THE PREFERRED EMBODIMENT

Figure 1:
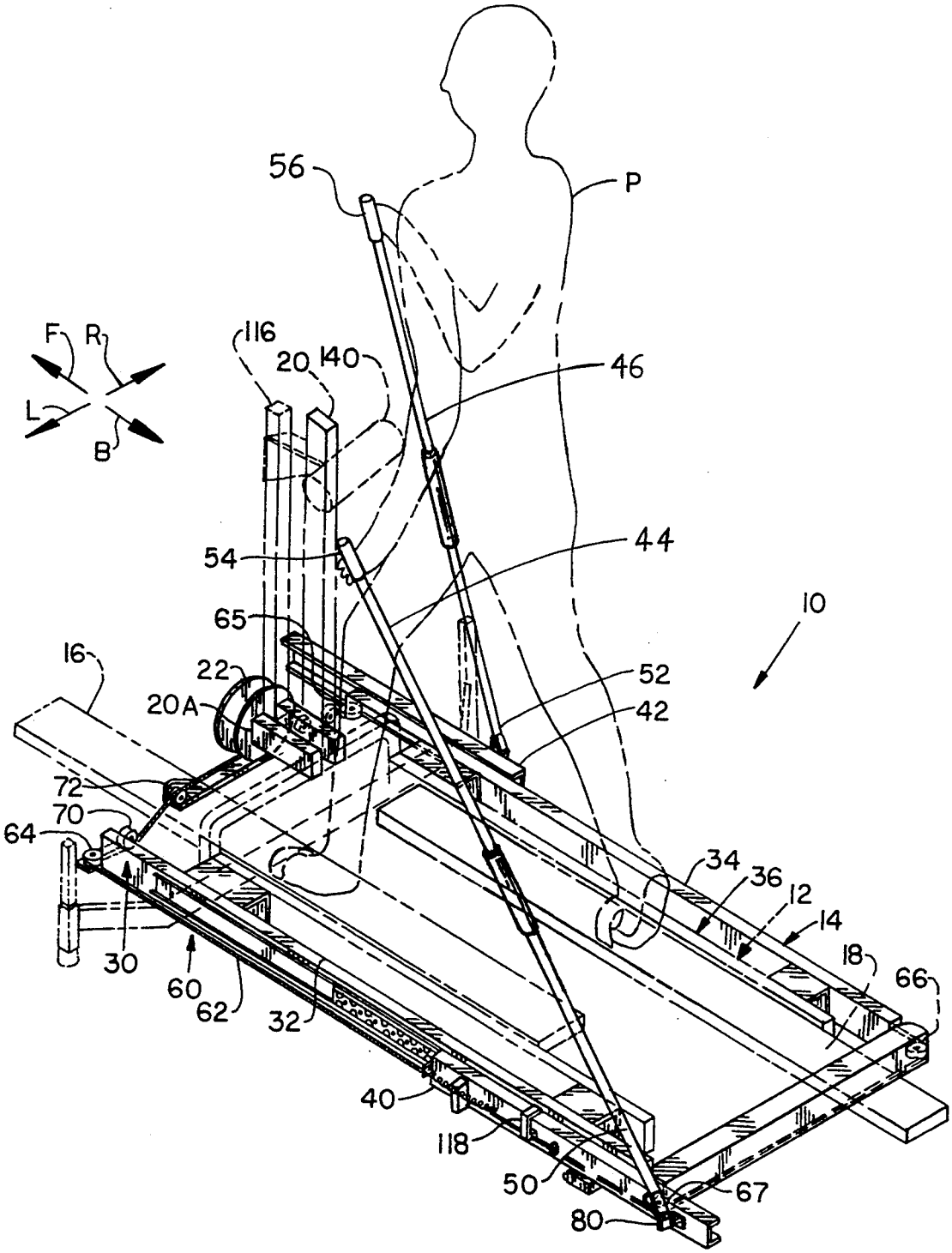
FIG. 1 is an isometric view of an exercise apparatus of the present invention, which includes an attachment of a present invention shown in solid lines and a prior art machine shown in phantom lines.

FIG. 1 illustrates an exercise apparatus 10 of the present invention, which includes a prior art NORDICTRACK cross-country ski simulator 12 and an attachment 14 of the present invention mounted thereon. The machine 12 includes a pair of skis 16, 18 that are slidable in longitudinal forward and rearward or backward directions F, B, and that are laterally spaced in left and right lateral directions L, R. The machine 12 is constructed so a largely vertical post 20 and swing up rod assembly 116 usually extends forwardly and in an upward incline, with a rope (not shown) wrapped about a drum pulley 22 (then at the top of the post), so a person P can pull on opposite sides of the rope as that person moves the skis forward and back against resistance. As discussed earlier herein, it takes about a week or more of daily practice for a person to become comfortable in use of the prior art machine 12. Applicant's attachment 14 allows the person to become comfortable with the apparatus 10 that combines the attachment with the prior art machine, in one day of about 30 minutes of exercise. Also, applicant's apparatus simulates true diagonal style cross-country skiing.

The attachment 14 comprises a framework 30 that includes a pair of stationary guides 32, 34 that are mounted at the left and right sides of the frame 36 of the prior art machine 12. The frame 36 and framework 30 can together be referred to as a frame assembly. A pair of slides 40, 42 in the form of channels, are slidably mounted on the guides so the slides 40, 42 can move in forward and rearward directions thereon. A pair of height-adjustable ski poles 44, 46, each of a length of a plurality of feet, have lower ends 50, 52 that are each pivotally mounted on a corresponding one of the slides 40, 42. In using the exercise apparatus 10, the person grasps upper ends 54, 56 of the ski poles and moves them forward and rearward as he moves the skis forward and rearward.

Applicant provides a mechanism 60 which couples the slides 40, 42 to cause them to move substantially in synchronism, in opposite forward and rearward directions. This is often referred to as the diagonal cross-country ski style, and is highly preferred in cross-country skiing. The mechanism 60 includes a cable 62 that extends around pulleys 64–67 located at the four corners of the largely rectangular framework 30. It is noted that the cable is guided by additional pulleys such as 70, 72 at the front of the framework to guide it in wrapping around the existing NORDICTRACK brake pulley 22 and avoid interference with the skis 16 and 18. The cable (which is preferably continuous but which can be in sections) is fixed to the right slide 42 and is coupled to the left slide 40, with portions of the cable extending both forward and rearward of each slide. As a result, when one of the slides such as 40 moves in one direction such as rearwardly, the other slide 42 will move in the opposite direction such as forwardly. Such movement is the proper movement in cross-country skiing, and the cable mechanism therefore promotes proper ski pole use.

Figure 2:
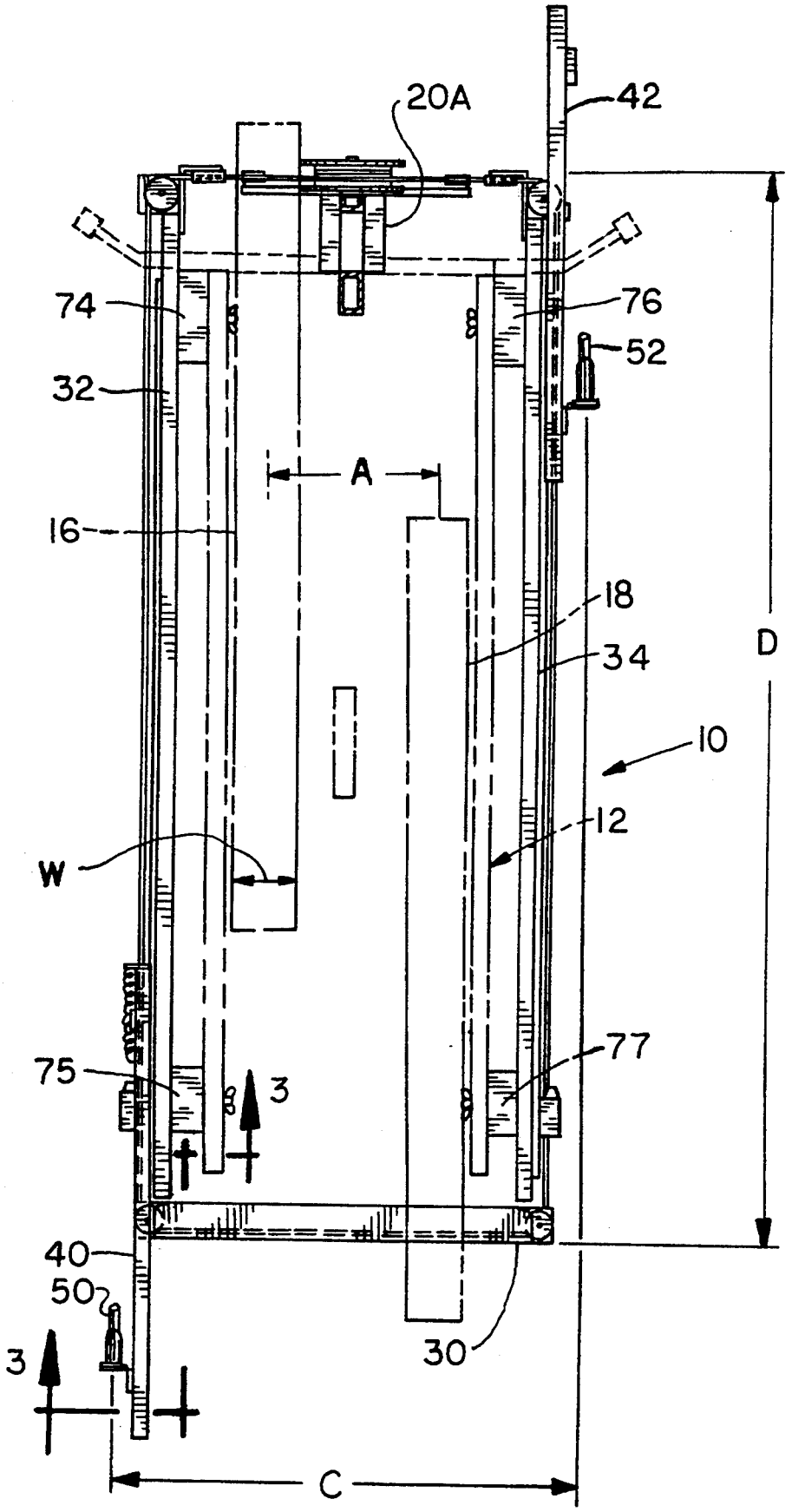
FIG. 2 is a plan view of the exercise apparatus of FIG. 1, with the attachment shown in solid lines and with most of the prior art machine shown in phantom lines.

As shown in FIG. 2, the skis 16, 18 are spaced apart by a distance A such as eight inches. Each of the skis has a width W of about two inches. The lower ends 50, 52 of the ski poles are spaced apart by a distance C of about 20 inches. In would be possible to mount ski slides only slightly laterally beyond each of the skis 16, 18. However, applicant provides the framework 30 with spacers 74–77 that hold the guides 32, 34 widely spaced to hold the bottom of the ski poles widely spaced. The wide spacing of the ski poles enables the person to achieve higher lateral stability.

When a beginner starts to move the skis back and forth, his body may tend to tilt to one side or the other. Without the ski poles, it may take perhaps a week or more of daily sessions, each of about one-half hour length, for a fit (and generally younger) person to feel comfortable on just the prior art machine 12. By providing ski poles whose lower ends are widely spaced, a person helps avoid a tendency to fall to the left or right by pressing on the ski poles (which is a major reason why poles are used in cross-country skiing). It takes perhaps one thirty minute session for a fit person to learn to rely on the ski poles to keep himself upright while moving the skis and ski poles back and forth. The great reduction in time required for a person to feel comfortable with the apparatus, and the ability of older and/or less fit person to become comfortable in use of the apparatus, resulting from the widely spaced ski poles, greatly encourages continued use of the exercise apparatus 10. That is, if a person does not feel comfortable using the device after a day or two, there is a considerable possibility that the person will merely store away the apparatus, and consider it a poor purchase. However, if the person begins to feel comfortable using the device after a relatively short period of time, then that person is much more likely to buy and/or continue to use the apparatus. The ski poles increase the age range of users and lessens the degree of dexterity required of the users. It also makes it easier to demonstrate and sell to customers.

Applicant prefers that the lateral spacing C between the centers of the ski pole lower ends be at least twice as great as the spacing A between the centers of the skis, or even greater than twice as great, such as approximately twenty inches.

Figure 3:
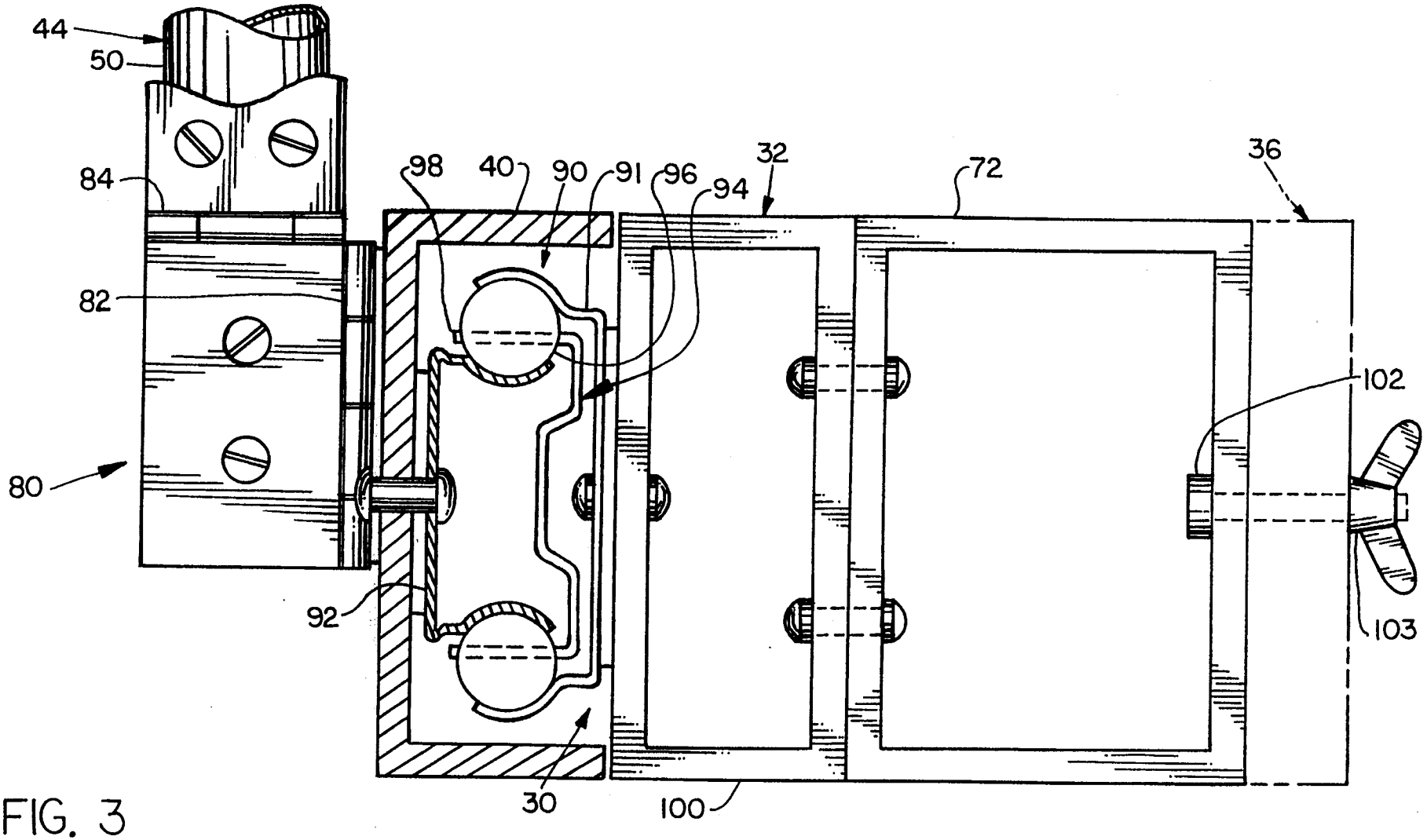
FIG. 3 is a view taken 3—3 of FIG. 2.

FIG. 3 shows a two-axis joint 80 which applicant uses to connect the lower end of each ski pole, such as the lower end 50 of pole 44, to a corresponding slide such as 40. The joint includes vertical and horizontal hinges 82, 84 that allow the ski pole to pivot about vertical and horizontal axes.

Applicant prefers to couple each slider such as 40 to one of the guides 32, by a ball slide unit such as 90. The unit 90 is of the type used to support drawers on file cabinets, which includes a static ball guide rail 91, a ball slide member 92 and a ball cage assembly 94 that includes balls 96 and a ball cage 98. Such ball slide units 90 are commonly used to hold a drawer in a file cabinet, although applicant found that he had to weld two drawer ball guide rails 91 in tandem in order to obtain a full ball guide rail 91 of sufficient length for use in the attachment. Applicant uses a rectangular tubular structural guide beam 100 to support the ball guide device 91, with beam-32 being riveted to the spacers such as 72. Each spacer 71–74 is attached by bolts such as 102 and wing nuts 103 to the corresponding side of the frame of the original machine 12, and the spacers and bolts can be considered to be a coupling that couples the ski pole enhancement attachment 14 to the frame of the prior art machine 12. Guide beam 32 supports cable pulleys, and is therefore made longer than the ball guide rail 91. The beams 32 and 34 are riveted to the spacers such as 71–74. It is noted that the bolts 102 mount in existing holes in the prior NORDICTRACK simulator.

Figure 4:
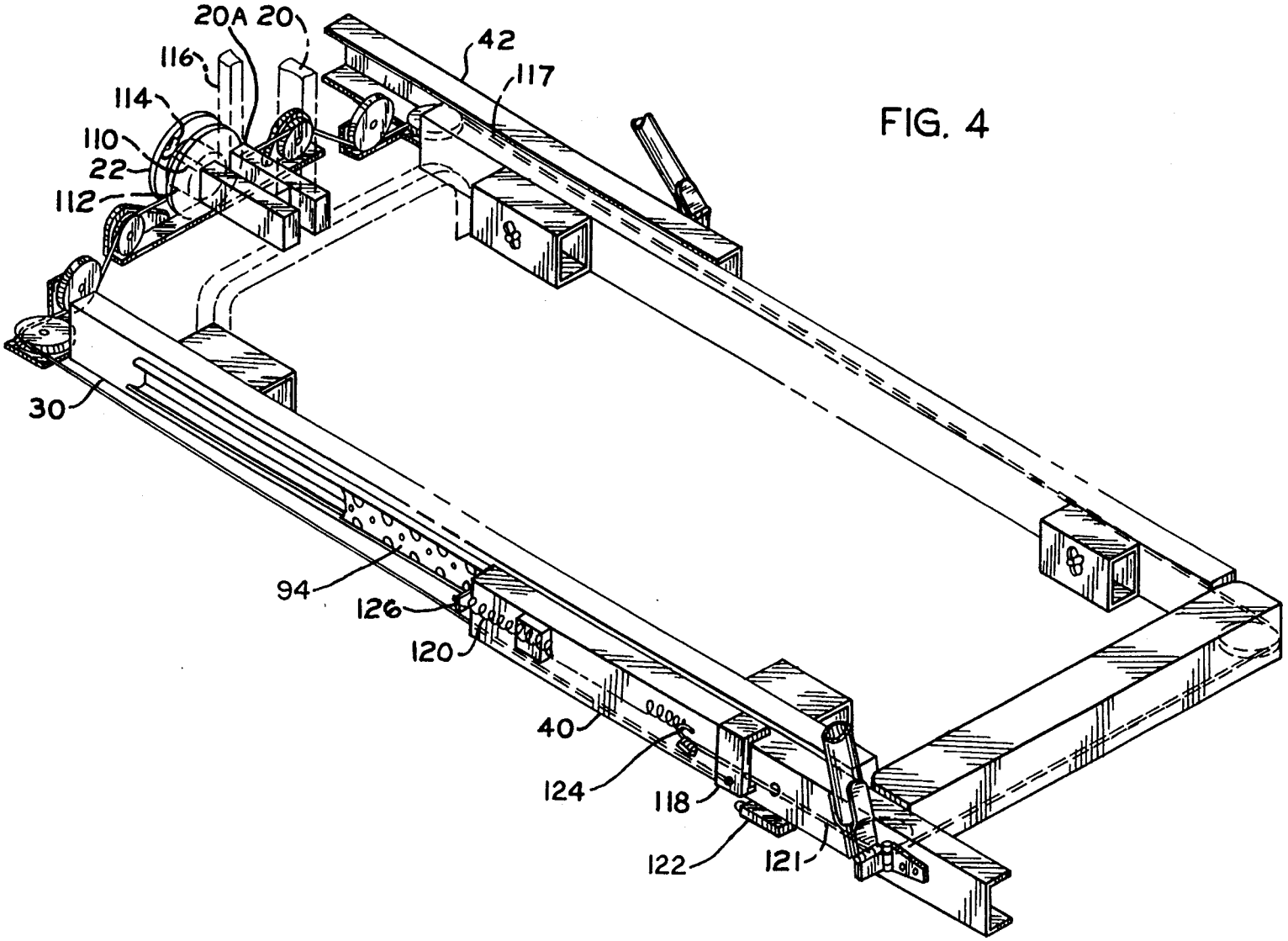
FIG. 4 is an isometric view of the attachment of FIG. 1.
Figure 5:
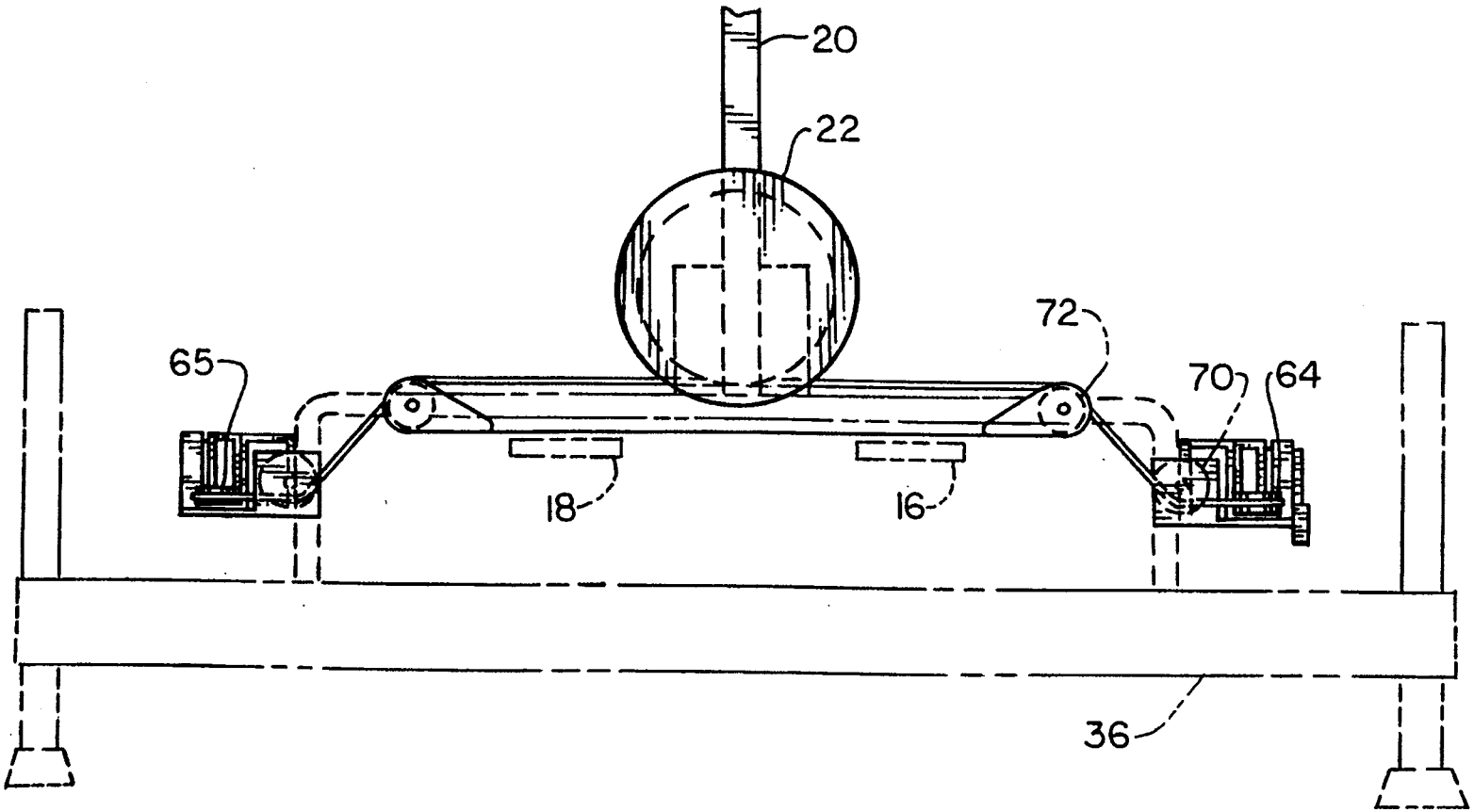
FIG. 5 is a front elevation view of the apparatus of FIG. 1, with the attachment shown in solid lines and most of the prior art machine shown in phantom lines.

The ball slide unit 90 provides for smooth sliding of the slides such as 40 on which the ski poles are mounted. As will be described below, considerable selective braking forces can be applied to the cable that couples the slides, so the low friction obtained by the ball slides is not significant. However, the ball slides have an advantage over simple slides (where a slide slides directly on low friction material on a stationary guide) in enabling the slides to move further forward or rearward and even beyond the framework. When the slide moves, the ball cage assembly 94 moves half as fast or far. As a result, when a slide is in an extreme forward or rearward position, such as a slide 40 shown in FIG. 4, the ball cage 94 will extend forward of the slide 40. Similarly, when the slide is in an extreme forward position such as shown for slide 42, its corresponding ball cage assembly will extend rearward of the slide 42.

The ball cage assembly 94 couples the slide 40 to the stationary ball guide rail 91 (FIG. 3), and holds up the slide even when its end extends a considerable distance rearward or forward of the ends of the ball rail guide 91.

The channel shaped extrusions 40 and 42 provide needed structural rigidity for the ball slide assembly members 92, 94. This is because when member 92 is maximally extended, large forces on the ski poles might otherwise cause the ball engaging members to twist. The channels 40, 42 also provide mounting members for ski poles 50, 52 and cable attachments. The advantage of this movement of the member 92 beyond the ball guide rail 91 is that the bottom ends of the ski poles can move rearward and forward by long distances (e.g. 4 feet) to simulate their use in cross-country skiing, and yet the attachment can be stored in a compact space that is about as long as required for the prior art machine 12 on which the attachment is mounted. The stationary guides 32, 34 preferably each extends along at least 50% of the length D of the frame or frame assembly, and actually extend along about 109% of it. The bottom of the ski poles move along distances that preferably are at least as long (i.e. over 90%) as the lengths of the guides.

Applicant has built and successfully tested an attachment of the illustrated construction, for a NORDICTRACK simulator 12, where the attachment has a length of about 54 inches, with about 52 inches of frame and about 2 inches of pulleys extending forward of the frame in the stored position (brake assembly pointed down and skis even) with each other. The ski pole travel was 48 inches, using a ball guide rail 91 of 44 inches length, a ball slide member 92 of 24 inches length, and a ball cage 94 of 18 inches length. The ski pole travel (of the joints 80 at the bottom) was 12 inches rearward of the existing NORDICTRACK simulator and 18 inches rearward of the front of the simulator. Travel beyond the rear end of the frame of the simulator 12, simulates true cross-country skiing using ski poles. The framework 30 of the attachment extends $4\frac{1}{4}$ inches behind the prior frame 36. The beams 32, 34 each had a length of 50 inches.

The brake drum pulley 22 (FIG. 4) is typically mounted on a shaft 110, and a braking mechanism 112 is included that can be adjusted by a control 114 to vary braking of the brake drum pulley 22. It is noted that in the case of the NORDICTRACK exerciser, such exerciser has a pulley 22 already built in to resist movement of a rope whose opposite ends are held in the hands of the person who is exercising. Such pulley and mechanism is held by a rod 116 which can be pivoted down from its prior art use position. Applicant uses the rod and pulley in their pivoted down position to resist movement of the cable that connects the slides, to provide braking of the ski poles and thereby simulate ski pole use in cross-country skiing. Applicant inserts a spacer block 20A between the post 20 and swing-up brake rod 116 of the prior simulator, to align the pulley 22 with other cable pulleys and to prevent sideward deflection of the rod 116 by cable forces.

The cable is fixed to the slide 42 (with an adjustment provision, not shown) at a cable middle location 117. The forward end of the left cable portion is fixed to slide 40 at location 118. Applicant picks up any slack in the cable by the use of an extension coil spring 120 which couples cable portion 121 through a coupling 124 to the spring, with the spring anchored to the slide at 126. The coil spring assures that there will be cable tension despite slight loosening of the cable by back and forth motion. Tension is required to assure braking by the capstan-type wrap-around brake pulley 22. The extension coil spring 120 also allows limited vertical adjustment of the stomach support cushion 140 (FIG. 1 ).

Applicant provides decelerators, or dashpots 122 which stops rearward movement of the slides, to avoid an abrupt jarring stops of ski-pole movement. Such dashpots slow the slide movement over a distance of a plurality of centimeters.

It is possible to obtain about the same motion of the ski pole handles or upper ends 50, 52, in movement along a largely straight line inclined at about 40°, by a complex linkage. However, such linkage is likely to have an increased cost, and with the simulation not being apparent. A not-so-accurate simulation can be achieved by straight ski poles of about 3.5 feet length with lower ends that are pivotally mounted at the front bottom of the frame, but with handles of about eight inches length whose lower ends are pivotally connected to the upper ends of such ski poles.

Thus, the invention provides an attachment for use with an existing cross-country ski simulating machine to help stabilize the user to facilitate his early comfortable use of the machine and provide exercise that will be useful in actual cross-country skiing, as well as an entire exercise apparatus. The attachment or exercise apparatus has a pair of guides that include structural guide beams on laterally opposite sides of the frame or framework and slides that move forward and rearward, with the lower ends of ski poles attached to the slides. A mechanism causes synchronist movement of the slides in opposite directions, and can comprise a cable extending substantially around the four corners of the framework. The sliding ski poles are widely spaced to enhance stability. Applicant can use an existing brake pulley used on present NORDICTRACK machines, to reduce the cost of an attachment.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An attachment for use with a ski simulating machine that has a frame and a pair of skis mounted on the frame to move in forward and rearward directions on the frame, comprising:

an attachment framework that includes a pair of stationary guides and a coupling device that is removably mountable on said frame, a pair of slides each resistance slidable in forward and rearward directions on a corresponding one of said guides, a pair of ski poles each having a lower end pivotally mounted on a corresponding one of said slides.

2. The attachment described in claim 1 wherein:

said coupling device is constructed so the lateral distance between the centers of the lower ends of said ski poles, is at least twice the lateral distance between the centers of said skis.

3. The attachment described in claim 1 including:

a mechanism which couples said slides to cause them to move substantially in synchronism in opposite forward and rearward directions.

4. The attachment described in claim 3 wherein:

said mechanism comprise a plurality of pulleys mounted on said framework and a cable that extends around said pulleys and that is connected to both of said slides to cause them to move in opposite directions in synchronism.

5. The attachment described in claim 4 wherein:

said framework is substantially rectangular and has four corner portions, and said pulleys include at least one pulley at each of said four corner portions, said cable including cable portions extending forwardly and rearwardly from each of said slides to a corresponding one of said pulleys.

6. The attachment described in claim 5 including:

a spring having a first end mounted on one of said slides and having a second end;

said cable has a first end substantially fixed to a first of said slides, and a second end fixed to said second end of said spring.

* * * * *